US010920396B1

(12) United States Patent
Richards et al.

(10) Patent No.: US 10,920,396 B1
(45) Date of Patent: Feb. 16, 2021

(54) HYDRAULIC SYSTEM FOR A MOTOR GRADER

(71) Applicant: Caterpillar Inc., Deerfield, IL (US)

(72) Inventors: Travis N. Richards, Chillicothe, IL (US); Ernest E. Stoops, Decatur, IL (US); Michael L. Repscher, Taylorville, IL (US); Stive Ramalho, Isle d'Abeau (FR); Wesley T. Payne, Plainfield, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/527,586

(22) Filed: Jul. 31, 2019

(51) Int. Cl.
*E02F 9/22* (2006.01)
*E02F 3/84* (2006.01)

(52) U.S. Cl.
CPC ..... *E02F 3/84* (2013.01); *E02F 3/841* (2013.01); *E02F 3/844* (2013.01); *E02F 9/2217* (2013.01); *E02F 9/2225* (2013.01); *E02F 9/2228* (2013.01); *E02F 9/2285* (2013.01); *E02F 9/2296* (2013.01)

(58) Field of Classification Search
CPC .... F15B 11/162; F15B 11/165; F15B 2211/45
See application file for complete search history.

(56) References Cited

U.S. PATENT DOCUMENTS 3,768,367 A 10/1973 Fuzzel
4,214,506 A * 7/1980 Bernhardt ..... F15B 11/165 91/527
5,680,760 A * 10/1997 Lunzman ..... E02F 9/2228 60/426
5,927,072 A 7/1999 Vannette
7,155,909 B2 * 1/2007 Toji ..... E02F 9/2228 60/468
7,240,486 B2 * 7/2007 Huang ..... F16D 31/00 60/413
7,614,335 B2 * 11/2009 Gradea ..... E02F 9/2203 60/420
7,866,149 B2 * 1/2011 Brinkman ..... E02F 9/221 60/378
9,366,272 B2 * 6/2016 Bieker ..... E02F 9/0875
10,144,450 B1 12/2018 Wen et al.
2018/0162441 A1 * 6/2018 Mate ..... B62D 5/30
2018/0354485 A1 * 12/2018 Adeeb ..... B60T 13/662

FOREIGN PATENT DOCUMENTS

CN 202345753 U 7/2012
CN 104074217 A 10/2014
CN 205329745 U 6/2016
CN 205779963 U 12/2016
CN 105864130 B 2/2018

* cited by examiner

*Primary Examiner* — Thomas E Lazo
(74) *Attorney, Agent, or Firm* — Bookoff McAndrews

(57) ABSTRACT

A hydraulic system for a motor grader is disclosed. The hydraulic system may include a first hydraulic subsystem and a second hydraulic subsystem. A pump may be configured to provide pressurized fluid to the first and second hydraulic subsystems. The hydraulic system may further include a control valve located upstream of the first and second hydraulic subsystems. The control valve may be configured to vary a standby pressure of pressurized fluid for use by the first and second hydraulic subsystems.

20 Claims, 2 Drawing Sheets

HYDRAULIC SYSTEM FOR A MOTOR GRADER

TECHNICAL FIELD

The present disclosure relates generally to hydraulic systems, and more particularly, to a hydraulic system for a motor grader.

BACKGROUND

Grading machines, such as motor graders, are typically used to cut, spread, or level materials that form a ground surface. To perform such earth sculpting tasks, grading machines include an implement, also referred to as a blade or moldboard. Grading machines often utilize hydraulic systems to provide functionality and control to various aspects of the machines. For example, some grading machines may utilize hydraulic fan systems, brake systems, implement systems, and steering systems that may each require separate fluid pumps.

Further, standby pressure, or the pressure at the pump during idle, for a hydraulic system may be set to a desired value based on performance tradeoffs. For example, a low standby pressure may enable lower fuel consumption, but the system may take longer to respond to a command (e.g., a steering command). In contrast, a high standby pressure may provide faster response time, but may require more fuel consumption. Further, in combined and integrated hydraulic system, the different systems may require different standby pressure settings. For example, the steering system may require a higher standby pressure setting than the implement system. Thus, current hydraulic systems for grading machines require separate subsystems to control system standby pressure settings and brake charging settings, necessitating additional components and cost.

U.S. Pat. No. 5,927,072, issued to Vannette on Jul. 27, 1999 ("the '072 patent), describes a load sense hydraulic system that includes a steering circuit, an implement circuit, and a brake circuit. The hydraulic system of the '072 patent includes an on/off valve in a load sense signal line of a pump. The on/off valve in the signal line causes the pump to upstroke to its high standby position when the brake valve is actuated, thus enabling faster brake valve response. However, the hydraulic system of the '072 patent is not disclosed as enabling variable control of the standby pressure setting and a brake charging setting.

The systems and methods of the present disclosure may address or solve one or more of the problems set forth above and/or other problems in the art. The scope of the current disclosure, however, is defined by the attached claims, and not by the ability to solve any specific problem.

SUMMARY

In one aspect, a hydraulic system for a motor grader is disclosed. The hydraulic system may include: a first hydraulic subsystem; a second hydraulic subsystem; a pump configured to provide pressurized fluid to the first and second hydraulic subsystems; and a control valve located upstream of the first and second hydraulic subsystems configured to vary a standby pressure of pressurized fluid for use by the first and second hydraulic subsystems.

In another aspect, a method of operating a hydraulic system for a motor grader is disclosed. The method may include: directing pressurized fluid from a pump toward a first hydraulic subsystem and a second hydraulic subsystem; directing the pressurized fluid toward a control valve located upstream of the first and second hydraulic subsystems; controlling the control valve to vary a standby pressure of pressurized fluid for use by the first and second hydraulic subsystems.

In yet another aspect, a hydraulic system for a motor grader is disclosed. The hydraulic system may include: a first hydraulic subsystem; a second hydraulic subsystem; a pump configured to provide pressurized fluid to the first and second hydraulic subsystems; and a control valve located upstream of the first and second hydraulic subsystems and configured to vary a standby pressure of pressurized fluid to the first and second hydraulic subsystems based on a mode of the motor grader.

BRIEF DESCRIPTION OF THE DRAWINGS

The accompanying drawings, which are incorporated in and constitute a part of this specification, illustrate various exemplary embodiments and together with the description, serve to explain the principles of the disclosure.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Further, relative terms, such as, for example, "about," "substantially," "generally," "approximately," and "proximate" are used to indicate a possible variation of 10% in a stated value.

Figure 1:
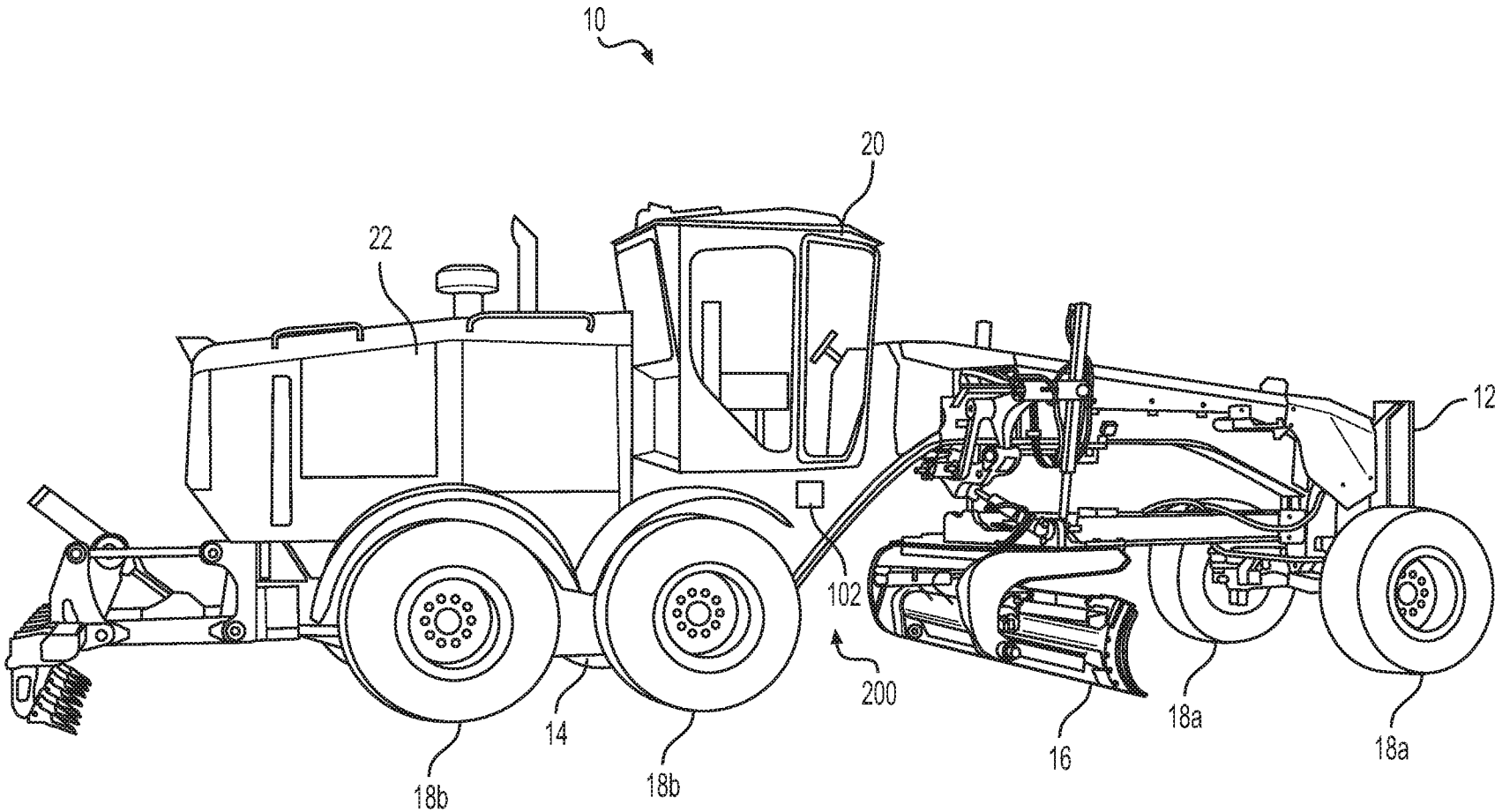
FIG. 1 is an illustration of an exemplary grading machine according to aspects of the disclosure.

FIG. 1 illustrates a perspective view of an exemplary motor grader machine 10 (hereinafter "motor grader"), according to the present disclosure. Motor grader 10 may include a front frame 12, a rear frame 14, and an implement 16. Front frame 12 and rear frame 14 may be supported by front wheels 18*a* and rear wheels 18*b*, respectively. An operator cab 20 may be mounted above a coupling of front frame 12 and rear frame 14, and may include various controls, display units, touch screens, or user interfaces to operate and/or monitor the status of the motor grader 10. Rear frame 14 also includes an engine 22 to drive and/or power motor grader 10. Implement 16 may include a blade, sometimes referred to as a moldboard, that may be used to cut, spread, or level (collectively "sculpt") earth or other material traversed by motor grader 10.

Additionally, a controller 102 may be in communication with one or more features of motor grader 10 and receive inputs from and send outputs to, for example, user interfaces in cab 20 or an interface remote from motor grader 10. In one aspect, motor grader 10 include electrohydraulic and/or hydro mechanical hydraulic systems, and controller 102 may control one or more electrical switches or valves in order to control one or more hydraulic cylinders, actuators, or electrical elements in order to operate motor grader 10. It is understood that controller 102 may include one or more controllers each associated with one or more components or systems of motor grader 10. For example, controller 102 may be in communication with a pump 210 for controlling aspects of pump 210, as further detailed below.

Figure 2:
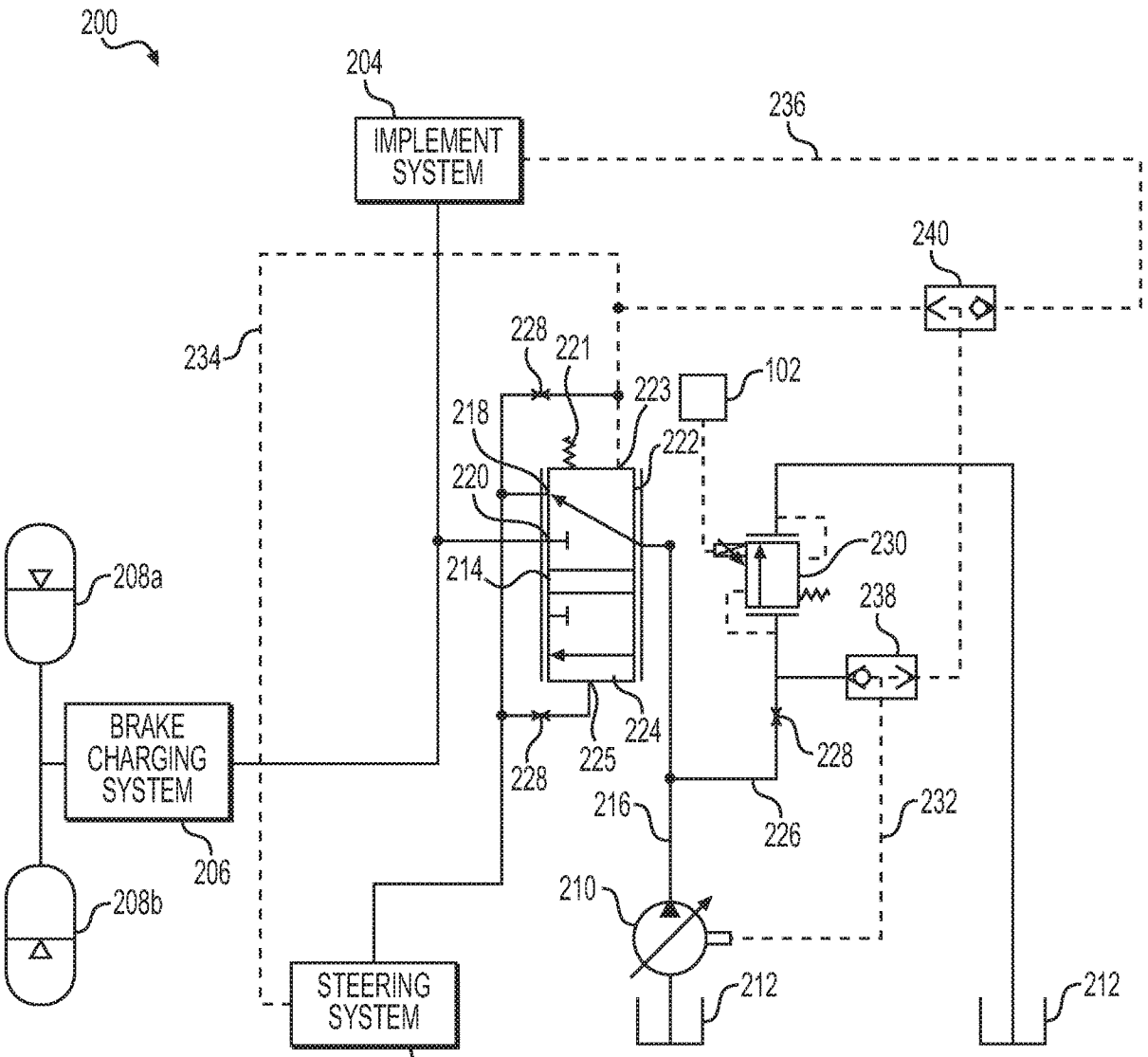
FIG. 2 is a schematic of an exemplary hydraulic system of the grading machine of FIG. 1.

FIG. 2 illustrates a schematic of an exemplary hydraulic system 200 of the motor grader 10. As shown in FIG. 2, motor grader 10 may include one or more hydraulic subsystems for controlling components of motor grader 10. The one or more hydraulic subsystems may include first, second, and/or third hydraulic subsystems. In one embodiment, the first, second, and third hydraulic subsystems may include, for example, a steering system 202, an implement system 204, and a brake charging system 206, respectively. While the exemplary embodiment is described as including steering, implement, and brake charging systems 202, 204, 206, it is understood that hydraulic system 200 may include other types of hydraulic subsystems, such as a fan system, park brake system, locking differential system, all wheel drive (AWD) system, or the like, and may include a single hydraulic subsystem or two or more integrated hydraulic subsystems.

Steering system 202 may include one or more actuators (not shown) associated with each of the front wheels 18*a*, respectively, and may be configured to mutually and correspondingly pivot for operatively executing a swiveling movement of the wheels 18*a* to steer motor grader 10. Further, implement system 204 may include one or more actuators, such as hydraulic cylinders, (not shown) associated with implement 16 and may be configured to actuate implement 16 to affect movement of the implement 16.

Brake charging system 206 may include one or more brakes (not shown) associated with the front wheels 18*a* and/or the rear wheels 18*b* and may be operable to resist movement of the motor grader 10. For example, the one or more brakes may include a hydraulic pressure-actuated wheel brake, such as, for example, a disk brake or a drum brake that is disposed intermediate the wheels 18*a*, 18*b* and a drive assembly (not shown) of the motor grader 10. The brakes may be operable from input devices, such as by a brake pedal within operator cab 20, and/or electrohydraulic valves located on motor grader 10.

One or more accumulators 208*a*, 208*b* may be fluidly associated with the one or more brakes. The accumulators 208*a*, 208*b* may be configured to hold a supply of pressurized fluid at a desired pressure and to provide the pressurized fluid to the brakes for slowing or stopping motor grader 10. One or more pressure sensors (not shown) may be associated with brake charging system 206 for sending a pressure signal command to controller 102. The pressure sensors may be configured to detect when fluid pressure in the accumulators 208*a*, 208*b* decreases below a preset limit, known as a cut-in pressure and to detect when fluid pressure in the accumulators 208*a*, 208*b* increases above a preset limit, known as a cut-out pressure. Brake charging system 206 may further include a valve (not shown), such as a pressure reducing valve, to limit the maximum pressure to brake charging system 206.

As further shown in FIG. 2, the steering system 202, implement system 204, and brake charging system 206 may be integrated hydraulically-driven systems of hydraulic system 200 that operate from a common pump 210. Pump 210 may be configured to draw fluid from a low pressure source 212, such as a tank or reservoir, configured to hold a supply of fluid. The fluid may include, for example, hydraulic oil, engine lubrication oil, transmission lubrication oil, or any other fluid known in the art. One or more hydraulic subsystems of motor grader 10, such as steering system 202, implement system 204, and/or brake charging system 206, may draw fluid from and return fluid to low pressure source 212.

In one embodiment, pump 210 may include a variable displacement pump. Pump 210 may be drivably connected to a power source (e.g., engine 22) by, for example, a countershaft, a belt, an electrical circuit, or in any other suitable manner. Pump 210 may be disposed downstream of low pressure source 212 and may supply pressurized fluid to steering system 202, implement system 204, and brake charging system 206. Pump 210 may be adjustable to selectively supply pressurized fluid at different pressures and different flow rates as a function of adjusting one or more parameters, for example, a swashplate angle of a variable displacement pump. Pump 210 may also have a minimum displacement and pressure setting, referred to as standby pressure, for maintaining a pressure in system 200 during an idle operation (e.g., when the steering, implement, and brake charging systems 202, 204, 206 are not in use). As such, pump 210 may substantially continually supply pressurized fluid to downstream components of hydraulic system 200.

In one embodiment, a priority valve 214 may be disposed downstream of pump 210 through a primary supply line 216. Priority valve 214 may connect with a priority flow port 218 connected to steering system 202 and an excess flow port 220 connected to implement system 204 and brake charging system 206. Priority valve 214 may further include a first position 222, or priority flow position, and a second position 224, or excess flow position. A spring 221 of priority valve 214 may bias the priority valve 214 to the first position 222, as shown, for communicating pump 210 with priority flow port 218. Priority valve 214 may be a pilot operated valve such that priority valve 214 may connect with a first pilot port 223 and a second pilot port 225. It is understood that a priority valve 214 may not be used and steering, implement, and brake charging systems 202, 204, 206 may be integrated by other means known in the art.

First pilot port 223 may be in communication with a steering system load sensing line 234 for biasing the priority valve 214 to the first position 222 when there is a load demand from the steering system 202. First pilot port 223 may also communicate a pressure from pump 210 (e.g., via load sensing line 234) for biasing priority valve 214 to the first position 222. Second pilot port 225 may communicate a pressure of steering system 202 to the priority valve 214 for biasing priority valve 214 to the second position 224 when there is no load demand from the steering system 202. For example, when steering system 202 does not require fluid (e.g., steering system 202 is not currently in use), pressure may increase at second pilot port 225. If the pressure at second pilot port 225 is greater than the sum of the pressure at first pilot port 223 and the force from spring 221, priority valve 214 will move to second position 224 for providing pressurized fluid from pump 210 to the implement and/or brake charging systems 204, 206. It is understood that the signal lines to first pilot port 223 and second pilot port 225 may include one or more orifices 228 and/or relief valves (not shown) for control of priority valve 214. Further, brake charging system 206 may take priority over implement system 204. For example, implement system 204 may include one or more compensators (not shown) in communication with a load sense network of implement system 204. The load sense network of implement system 204 may receive a signal from brake charge system 206 and may be communicated to the one or more compensators. Because brake charge system 206 does not include such compensators, brake charge system 206 will have priority flow over implement system 204. It is understood that priority to brake charge system 206 may be accomplished by other methods and implement system 204 may have priority over brake charge system 206.

Hydraulic system 200 may further include a branch line 226 that is configured to branch off from primary supply line 216 upstream of priority valve 214 and connect to a low pressure source 212. A control valve 230 may be disposed in branch line 226 and may be in communication with controller 102 for receiving control signals. Control valve 230 may include a proportional valve element that may be spring biased and solenoid actuated (e.g., via a control signal from controller 102) to move the valve element among a plurality of positions between a substantially flow blocking position (or substantially closed position) and a fully opened position. The amount of pressurized fluid directed toward low pressure source 212 may be a function of the position of control valve 230 and, thus, the corresponding amount of flow area thereof. As such, control valve 230 may be configured to regulate fluid pressure in a load sensing line 232 associated with pump 210. Control valve 230 may further include first and second pilot lines (shown as dashed lines) upstream and downstream of control valve 230, respectively, for communicating reference load pressures to control valve 230. It is understood that control valve 230 may be any type of control valve, such as, for example, mechanically operated, hydraulically operated, electro-hydraulic, pneumatic, or the like.

During a non-operational state of the steering, implement, and brake charging system 202, 204, 206, pump 210 may be operated to maintain a minimum displacement and pressure setting (e.g., the standby pressure) for use by the steering system 202 and/or the implement system 204. As such, the standby pressure may be regulated by the control valve 230. Further, an orifice 228 may be disposed in branch line 226 between pump 210 and control valve 230 and may regulate a pressure drop from pump 210 to low pressure source 212. For example, when control valve 230 is in the fully opened position, there is no load communicated to pump 212 (e.g., via load sensing line 232). When control valve 230 is controlled to the substantially flow blocking position, fluid from pump 212 may flow into branch line 226 and over orifice 228 and a pressure may be communicated to pump 212 via load sensing line 232. Thus, an amount of fluid flow may be used by the load sensing line 232 that results in wasted flow or energy of hydraulic system 200. Therefore, orifice 228 may be sized to provide stable control of the standby pressure, while reducing the amount of wasted flow or energy when hydraulic system 200 is at a minimum standby pressure setting.

Load sensing line 232 may further include steering system load sensing line 234 and implement system load sensing line 236. Load sensing lines 234 and 236 may provide a feedback pressure signal to the pump 210 that is indicative of an amount of load demand on the steering system 202 and implement system 204, respectively. One or more resolver valves 238, 240 may also be disposed in load sensing line 232. Inputs of resolver valve 240 may include pressure of fluid from steering system 202 (e.g., via load sensing line 234) and pressure of fluid from implement system 204 (e.g., via load sensing line 236). The fluid having a higher pressure value among the inputs may help bias the resolver valve 240 into a first position or a second position, respectively. For example, the high fluid pressure input from among the inputs may be output from the resolver valve 240. Inputs of resolver valve 238 may include the output of resolver valve 240 (e.g., the fluid with the higher pressure between the steering system 202 and the implement system 204) and pressure of fluid from branch line 226. Resolver valve 238 may likewise output the fluid having a higher pressure. It is understood that resolver valves 238, 240 may be any type of valves for blocking a fluid with a lower pressure, such as a ball valve or the like.

Fluid pressure at the load sensing line 232 may be used to control the output of pump 210. For example, the fluid pressure from load sensing line 232 may control a position of a swashplate of pump 210. When pressure in load sensing line 232 is high (e.g., as controlled by control valve 230), the swashplate angle may be positioned at a maximum angle. The maximum angle may correspond to the maximum displacement and may lead to a maximum rate of fluid flow from pump 210. Thus, the angle of the swashplate, and the corresponding fluid flow rate, may vary as a function of the fluid pressure in load sensing line 232 as controlled by control valve 230. It is understood that load demands from steering system 202 and implement system 204, as communicated from load sensing lines 234, 236, may also be used to control the swashplate angle.

INDUSTRIAL APPLICABILITY

The disclosed aspects of hydraulic system 200 of the present disclosure may be used in any motor grader 10 or other machine having one or more hydraulic subsystems.

To vary the standby pressure setting of the system 200, control valve 230 may be configured to be dynamically actuated in a manner to control the differential pressure of the orifice 228. For example, control valve 230 may be controlled (e.g., via a control signal from controller 102) to a position proximate the substantially closed position (e.g., to enable a minimal amount of fluid to be passed to the low pressure source 212) for providing higher pressure in the load sensing line 232. Accordingly, standby pressure may be at a maximum value. Likewise, control valve 230 may be controlled (e.g., via a control signal from controller 102) to a position proximate the fully opened position (e.g., to enable an amount of fluid slightly less than a maximum amount to be passed to the low pressure source 212) for providing a lower pressure in the load sensing line 232. Accordingly, standby pressure may be at a minimum value. It is understood that control valve 230 may be positioned at any intermediate position between the fully opened position and the substantially closed position in order to correspondingly vary the standby pressure.

Further, different modes of motor grader 10 may require different standby pressure settings. For example, motor grader 10 may include a first mode in which implement 16 is idle or near idle for an extended amount of time (e.g., when motor grader 10 needs to traverse the ground surface without using implement 16), and thus only the steering system 202 may be selectively used. Motor grader 10 may also include a second mode in which implement 16 may be selectively actuated frequently. As such, a lower standby pressure (e.g., 4,000 kPa) may be provided for steering system 202 in the first mode and a higher standby pressure (e.g., 10,000 kPa) may be provided for implement system 204 in the second mode. To control the standby pressure, controller 102 may receive input of a mode of motor grader 10 and send a control signal to control valve 230 for positioning control valve 230 to achieve the desired standby pressure. For example, controller 102 may receive a signal that motor grader 10 is in the first mode and may send a control signal to control valve 230 for positioning the control valve 230 to a first position for providing a first standby pressure. Similarly, controller 102 may receive a signal that motor grader 10 is in the second mode and may send a control signal to control valve 230 for positioning control valve 230 to a second position for providing a second standby pressure that is different than the first standby pressure. It is understood that motor grader 10 may include any number of modes that may be operated with any standby pressure setting between the maximum and minimum standby pressure setting.

During operation of motor grader 10, priority valve 214 may operate to satisfy the demands of steering system 202 in the first position 222 before excess fluid is passed to excess fluid port 220 in the second position 224. For example, spring 221 may bias priority valve 214 to the first position 222 such that pressurized fluid is directed from pump 210 to steering system 202. When the demands of the steering system 202 are met and/or there is no demand from the steering system 202, pressure may build and be communicated to second pilot port 225. When the pressure received from second pilot port 225 increases to overcome the force from spring 221 and the pressure received from first pilot port 223, priority valve 214 may move to second position 224 such that pressurized fluid is directed from pump 210 to implement system 204 and/or brake charging system 206.

Control valve 230 may also control brake charging to the accumulators 208*a*, 208*b*. For example, when pressure of one or more of the accumulators 208*a*, 208*b* decreases to the cut-in pressure, control valve 230 may be positioned to the substantially closed position such that pressure may be supplied to the load sensing line 232. When pressure in load sensing line 232 increases, priority valve 214 may move to the second position 224 to direct pressurized fluid to brake charging system 206. Thus, pump 210 may provide pressurized fluid to the accumulators 208*a*, 208*b*. When pressure of one or more of the accumulators 208*a*, 208*b* increases to the cut-out pressure (e.g., indicating the accumulators 208*a*, 208*b* are charged), control valve 230 may be controlled (e.g., via controller 102) to move away from the substantially flow blocking position to vary the standby pressure to the steering and implement systems 202, 204, as detailed above.

Such a hydraulic system 200 may reduce complexity of the hydraulic systems for motor grader 10. For example, hydraulic system 200 may enable the steering, implement, and brake charging systems 202, 204, 206 (or any other hydraulic subsystem) to be combined and integrated to a single pump 210. As such hydraulic system 200 may reduce the number of components of the hydraulic subsystems of motor grader 10. Further, hydraulic system 200 may enable variable control of standby pressure settings and control of brake charging settings.

It will be apparent to those skilled in the art that various modifications and variations can be made to the disclosed system without departing from the scope of the disclosure. Other embodiments of the disclosure will be apparent to those skilled in the art from consideration of the specification and practice of the invention disclosed herein. For example, hydraulic system 200 may be used on any machine having integrated hydraulic systems. It is intended that the specification and examples be considered as exemplary only, with a true scope and spirit of the invention being indicated by the following claims.

What is claimed is:

1. A hydraulic system for a motor grader, comprising:
- a first hydraulic subsystem;
- a second hydraulic subsystem;
- a pump configured to provide pressurized fluid to the first and second hydraulic subsystems;
- a control valve located upstream of the first and second hydraulic subsystems configured to vary a standby pressure of pressurized fluid for use by the first and second hydraulic subsystems, wherein the standby pressure is a pressure of pressurized fluid maintained during an idle operation; and
- a controller configured to:
  - control the control valve to a first position for a first standby pressure; and
  - control the control valve to a second position for a second standby pressure, the second standby pressure being different than the first standby pressure.

2. The system of claim 1, wherein the control valve is configured to move in a plurality of positions between a fully opened position and a substantially closed position to vary an amount of pressurized fluid directed to a low pressure source.

3. The system of claim 2, wherein the standby pressure to the first and second hydraulic subsystems is a function of a position of the control valve.

4. The system of claim 3, wherein the controller is configured to:
- receive a signal indicative of a mode of the motor grader; and
- control the control valve to a position based on the mode of the motor grader to vary the standby pressure.

5. The system of claim 4, wherein the controller is configured to:
- control the control valve to the first position in a first mode of the motor grader for the first standby pressure; and
- control the control valve to the second position in a second mode of the motor grader for the second standby pressure.

6. The system of claim 5, further comprising an orifice located between the pump and the control valve and configured to regulate a pressure drop of pressurized fluid from the pump to the low pressure source.

7. The system of claim 6, further comprising a third hydraulic subsystem including at least one accumulator,
- wherein the control valve is further configured to be controlled to the substantially closed position to direct the pressurized fluid to the third hydraulic subsystem to charge the at least one accumulator.

8. The system of claim 7, further comprising a priority valve disposed between the pump and the first, second, and third hydraulic subsystems, the priority valve including:
- a first position configured to direct the pressurized fluid from the pump to the first hydraulic subsystem; and
- a second position configured to direct the pressurized fluid from the pump to the second and third hydraulic subsystems.

9. The system of claim 8, wherein the first hydraulic subsystem is a steering system, the second hydraulic subsystem is an implement system, and the third hydraulic subsystem is a brake charging system.

10. A method of operating a hydraulic system for a motor grader, the method comprising:
- directing pressurized fluid from a pump toward a first hydraulic subsystem and a second hydraulic subsystem;
- directing the pressurized fluid toward a control valve located upstream of the first and second hydraulic subsystems; and controlling the control valve to vary a standby pressure of pressurized fluid for use by the first and second hydraulic subsystems, wherein the standby pressure is a pressure of pressurized fluid maintained during an idle operation, wherein the controlling the control valve to vary the standby pressure includes:

controlling the control valve to a first position for a first standby pressure; and controlling the control valve to a second position for a second standby pressure, the second standby pressure being different than the first standby pressure.

11. The method of claim 10, further comprising controlling the control valve to a plurality of positions between a fully opened position and a substantially closed position to vary an amount of pressurized fluid directed to a low pressure source.

12. The method of claim 11, wherein the standby pressure to the first and second hydraulic subsystems is a function of a position of the control valve.

13. The method of claim 12, further comprising:

receiving an indication of a mode of the motor grader; and controlling the control valve to a position based on the mode of the motor grader to vary the standby pressure.

14. The method of claim 13, further comprising:

controlling the control valve to the first position in a first mode of the motor grader for the first standby pressure; and controlling the control valve to the second position in a second mode of the motor grader for the second standby pressure.

15. The method of claim 14, further comprising directing the pressurized fluid through an orifice located between the pump and the control valve for regulating a pressure drop of pressurized fluid from the pump to the low pressure source.

16. The method of claim 15, further comprising closing the control valve to the substantially closed position to direct the pressurized fluid to a third hydraulic subsystem to charge at least one accumulator of the third hydraulic subsystem.

17. The method of claim 16, further comprising:

directing the pressurized fluid from the pump to a priority valve;

directing the pressurized fluid from the priority valve to the first hydraulic subsystem in a first position of the priority valve; and directing the pressurized fluid from the priority valve to the second and third hydraulic subsystems in a second position of the priority valve.

18. A hydraulic system for a motor grader, comprising:

a first hydraulic subsystem;

a second hydraulic subsystem;

a third hydraulic subsystem;

a pump configured to provide pressurized fluid to the first, second, and third hydraulic subsystems;

a control valve located upstream of the first, second, and third hydraulic subsystems and configured to vary a standby pressure of pressurized fluid to the first and second hydraulic subsystems based on a mode of the motor grader, wherein the standby pressure is a pressure of pressurized fluid maintained during an idle operation; and a controller configured to:

control the control valve to a first position for a first standby pressure;

control the control valve to a second position for a second standby pressure, the second standby pressure being different than the first standby pressure; and control the control valve to a substantially closed position to direct the pressurized fluid to the third hydraulic subsystem.

19. The system of claim 18, wherein the control valve is configured to be controlled to the first position in a first mode of the motor grader for the first standby pressure; and wherein the control valve is configured to be controlled to the second position in a second mode of the motor grader for the second standby pressure.

20. The system of claim 19, wherein the first mode is selected based on an application of the first hydraulic subsystem and the second mode is selected based on an application of the second hydraulic subsystem.

* * * * *